US007086424B2

(12) United States Patent
Debaes et al.

(10) Patent No.: US 7,086,424 B2
(45) Date of Patent: Aug. 8, 2006

(54) METHOD AND SYSTEM FOR WEAVING FABRICS WITH TWO USEABLE SIDES

(75) Inventors: Johny Debaes, Moorslede (BE); Ludo Smissaert, Assebroek (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/121,188

(22) Filed: May 4, 2005

(65) Prior Publication Data

US 2005/0247367 A1 Nov. 10, 2005

(30) Foreign Application Priority Data

May 7, 2004 (BE) ..... 2004/0227

(51) Int. Cl.
*D03D 25/00* (2006.01)

(52) U.S. Cl. ..... 139/418; 139/20; 139/21; 139/416; 139/417

(58) Field of Classification Search ..... 139/20, 139/21, 417, 416, 418
See application file for complete search history.

(56) References Cited

U.S. PATENT DOCUMENTS

| | | | | |
|---|---|---|---|---|
| 395,462 | A * | 1/1889 | Taylor | 139/418 |
| 658,181 | A * | 9/1900 | Johnston | 139/418 |
| 698,743 | A * | 4/1902 | Scholes | 139/418 |
| 808,976 | A * | 1/1906 | Dorman | 139/412 |
| 4,197,345 | A * | 4/1980 | Worrall | 442/186 |
| 4,848,412 | A * | 7/1989 | Pittman et al. | 139/383 R |
| 5,758,697 | A * | 6/1998 | Musha et al. | 139/192 |
| 6,173,746 | B1 * | 1/2001 | Debaes et al. | 139/392 |
| 6,182,708 | B1 * | 2/2001 | Smissaert | 139/21 |
| 6,247,506 | B1 * | 6/2001 | Debaes et al. | 139/402 |
| 6,457,489 | B1 * | 10/2002 | Smissaert | 139/21 |

FOREIGN PATENT DOCUMENTS

| | | |
|---|---|---|
| BE | 1008131 | 1/1996 |
| EP | 0974689 | 1/2000 |
| EP | 0974690 | 1/2000 |
| EP | 1347087 | 3/2002 |
| JP | 2003/293246 | 10/2003 |

* cited by examiner

*Primary Examiner*—John J. Calvert
*Assistant Examiner*—Robert H Muromoto
(74) *Attorney, Agent, or Firm*—James Creighton Wray

(57) ABSTRACT

This invention relates to a method and to a system for weaving fabrics with two useable sides (W1), (W2), in which per operating cycle one weft thread (6) is inserted, and in which each fabric comprises a first figure warp thread (1) and a second figure warp thread (2) that, in a number of operating cycles, are positioned together alternately above and below the weft insertion level, so that, at both fabric sides, these figure warp threads (1), (2) are bound over the same weft threads (6), while running above one another, and in which the mutual position (upper or lower position) taken up by the first figure warp thread (1) and the second figure warp thread (2) in each fabric (W1), (W2) during the weaving process is determined selectively according to a previously defined figure pattern, preferably by positioning the first (1) and second figure warp threads (2) in a first shed (I) at a first level (POS. 1) at one side of the weft insertion level and in a second shed (II), selectively on a different second level (POS. 2) and third level (POS. 3), at the other side of the weft insertion level. The invention also relates to fabrics (W1), (W2) woven according to such method.

37 Claims, 10 Drawing Sheets

METHOD AND SYSTEM FOR WEAVING FABRICS WITH TWO USEABLE SIDES

This application claims the benefit of Belgian Application No. 2004/0227 filed May 7, 2004, which is hereby incorporated by reference in its entirety.

BACKGROUND OF THE INVENTION

On the one hand, this invention relates to a method for weaving a fabric, characterized in that in successive work cycles of a weaving machine a shed is formed between the warp threads of a number of warp thread systems and one weft thread is inserted in this shed at a weft insertion level, and characterized in that, in each shed, the warp threads are positioned in relation to the weft insertion level in a manner that, together with the inserted weft threads, they form a fabric that displays on both sides figure shaping warp threads and on the other hand, this invention relates to a weaving machine to apply this method according to the invention.

The invention furthermore relates to a weaving machine provided to realize such method as well as to a fabric that on both sides displays figure shaping warp threads.

Fabrics with two useable sides are formed, on the one hand, from weft threads that are inserted crosswise in the fabric and, on the other hand, from warp threads that are fed lengthwise for fabric structuring, on the one hand comprising figure warp threads that are positioned in relation to the weft threads, in order to shape the desired figure, and, on the other hand comprising binding warp threads that are inserted to bind over the weft threads and to define a fabric (structure).

In this patent application, the term 'figure warp threads' means: warp threads provided to enable working in a figure shaping way.

Optionally, also tensioning warp threads can be applied, in order to position the weft threads also in the height direction in relation to each other and to realize new aspects and higher densities. During the weaving process, the warp threads are always positioned in relation to the one or more weft insertion levels, called shed formation, in order to subsequently insert the one or several weft threads and to press the weft threads by means of the reed against the fabric edge with the purpose of adding a fabric line to the fabric in this manner. Upon this, the warp threads take up a new position in relation to the weft insertion means, which corresponds with the desired binding structure and the desired figure shape, the one or several weft threads are again inserted and the reed presses the inserted weft threads against the fabric edge. This cycle is continually repeated until the desired fabric is formed.

Fabrics with two useable sides with figure shaping on both sides of the fabric are already known. First, there is the well-known Kelim weaving technique in which, over a system of adjacently running warp threads, through an up and down movement, over a certain section of the width, weft threads are woven between the warp threads (according to the desired figure), in order to be re-conducted at the end of said section of the width and to be woven at the other side of the fabric and in the same manner in the returning direction between the warp threads in such manner that the weft threads cover the warp threads. The different weft threads, positioned adjacently to each other in the weft direction, are woven together so that no "tear" is created for any vertical lines in the drawing. The result is a fabric with two useable sides with the same figure on both sides. The fabric is produced manually because the wefts are to be inserted only over a limited section of the width.

Additionally, in plain weaving, there are known techniques such as, for instance, Gobelin weaving with double-sided weft as described in: Die Weberei by Ernst Gräbner, published in 1951 by Fachbuchverlag GmbH—Leipzig (pp 304 to 311). In this document is described how by insertion of multiple wefts with different properties (color, structure) a fabric with two useable sides can be woven with a different (or same) figure pattern on both sides. This can be done by means of two figure shaping weft threads, with different properties, which are inserted one after the other. By insertion of a "stem warp yarn", which each time is positioned between both weft threads, it is determined which weft thread will become figure shaping at which side of the fabric with two useable sides. A weft thread that in a certain place in the fabric is used at the topside can no longer be used at the same place at the bottom side and vice versa. By this, a complementary fabric is created, namely a fabric in which different weft threads shape one and the same figure both at one side and at the other side of the fabric, with the characteristic that weft thread 1 determines the effect (color, structure) at one side, whereas weft thread 2 does this at the other side.

These effects alternate simultaneously from one side to the other in order to shape a figure in this way, which, at both sides, only differs from the other one by the effect realized by both yarn types.

By inserting more figure shaping weft threads, different figures can be shaped at the topside and the bottom side of a fabric with two useable sides, on condition that a second "stem warp yarn" is added to separate the non-figure-shaping weft threads from the weft threads shaping figures at both sides of the fabric. The disadvantage of this method is, on the one hand, that per woven fabric line (realized per beat of the reed) at least as many weft threads as there are figure shaping weft threads active in that fabric line must be inserted and, on the other hand, that two "stem warps" are required when inserting more than two figure shaping weft threads. Moreover, it is a well-known fact that figure shaping weft threads are not always very suitable to be inserted as weft threads. This is in particular the case for weaving machines with air jet insertion, given that not all figure shaping yarn kinds are suitable to be inserted as weft yarn through a shed by means of a jet of air. In warp direction, this limitation does not apply.

As, by this technique, at the figure shaping side, only one weft lies above the stem warp yarn, said technique does not allow weaving of rib-shaping fabrics by positioning multiple wefts above one another, as, in a case like this, we cannot say with certainty which one of both wefts will be figure shaping. In addition, it is a fact that effect yarns in weft direction cannot be fixed as firmly between the warp threads as effect yarns in warp direction can be fitted between the weft threads. In weft direction, they are inserted in one cycle over the entire width; in warp direction, cycle per cycle, they are pressed against the fabric edge under warp tension by the beating movement of the reed.

European patent publication EP 0 974 689 describes how a double-sided fabric is produced with figure shaping warp threads, characterized in that, per warp yarn, an additional warp thread is inserted and two weft threads are superposed. The additional warp keeps both weft threads further apart from each other and, as such, provides a more pronounced rib effect to both sides of the fabric. A disadvantage of such method is increased yarn consumption, on the one hand, due to the requirement for an additional warp thread that will be nowhere visible and, on the other hand, because of the necessity to insert two weft threads per figure shaping loop.

In FIG. 2 of European patent publication EP 0 974 690, a method is shown and described in which two rib-shaping fabrics are woven according to the double face principle, characterized in that the non-active pile warp threads are not bound in along the tensioning warp thread but are woven in a wavy manner and alternately over a weft thread located at the topside of the fabric in relation to the tensioning warp thread and over a weft thread located at the bottom side of the fabric in relation to the tensioning warp thread. The thus formed fabric is ribbed at one side by loops supported by a weft thread, so-called false loops. Moreover, the herein-described fabric has an additional weft thread to form the false loop. The hereby-created fabric with two useable sides, with figure shaping at both sides, has the disadvantage of comprising two sides with dissimilar properties because of the one-sided rib formation.

In double-sided fabrics with figure shaping threads, we are confronted with the problem that we have to position the threads that are capable of figure shaping in such relation to each other that, at the bottom and at the top of the fabric, the desired figure shaping threads will become visible and the others will remain invisible. With the prior art, we work on the one hand with figure shaping weft threads that are kept apart from each other by one or more "stem warps". This has as disadvantage that a fabric line can only be added to the fabric after insertion of a number of wefts by an amount that is at least equal to the number of figure shaping weft threads inserted in the fabric line. In other words, several weft threads are needed for each fabric line added to the fabric. Moreover, additional warp threads are needed, which ensure that the adjacently inserted weft threads place themselves in the desired sequence above one another. Weft threads inserted in this manner can never be woven as firmly between the warp threads as figure shaping warp threads can be woven between the weft threads.

On the other hand, we work with warp threads as figure shaping yarns and, until today, in relation to each weft insertion level, we only worked with two positions to position the weft threads: above the weft insertion device or below the weft insertion device. When, during the shed formation, we simultaneously move two figure shaping warp threads in this manner from one same position to another same position (from a position above the weft insertion device to a position below the weft insertion device or vice versa), we cannot predict which warp thread will fix itself against the weft thread and which weft thread will fix itself to the outer side of the fabric and will be figure shaping. In the prior art, this was solved by, for instance, working with two weft threads above one another and by providing an extra warp thread between the two weft threads.

The purpose of the invention is to provide a method and a system by which a fabric, displaying figure shaping warp threads at both sides, can be produced without the mentioned disadvantages.

In this patent application, the term 'figure shaping warp threads' is used in the sense of figure warp threads that are effectively shaping a figure. 'Non-figure-shaping warp threads' are figure warp threads that, at some location in the fabric, are not figure shaping.

This purpose is met by providing a method for weaving a fabric with the properties as indicated in the first paragraph of this description, characterized in that at least one warp thread system comprises a first and second figure warp thread that, in a number of operating cycles, are positioned together alternately above and under the weft insertion level, so that, at both fabric sides, these figure warp threads are bound over the same weft threads, while running above one another, the upper figure warp thread being figure shaping at the topside of the fabric and the lower figure warp thread being figure shaping at the bottom side of the fabric, and characterized in that, according to this invention, during the weaving process, the mutual position taken up in the fabric by the first and the second figure warp thread is determined selectively according to a previously defined figure pattern.

In this way, the purpose of the invention is realized. On a weaving machine, a fabric with two useable sides is manufactured with figure shaping at both sides, by means of warp threads, according to a method by which only one weft thread per operating cycle of the weaving machine is to be inserted and in which no additional warp threads are required.

In such method, in order to realize the desired binding structure for the weft threads, also ground warp threads can be positioned in the successive sheds.

In the method according to the invention, the cited first and second figure warp threads are preferably positioned in a first shed at a first level at one side of the weft insertion level and in a second shed at a different second level and third level at the other side of the weft insertion level, while the positions of the first figure warp thread and the second figure warp thread in the second shed determine the aforementioned mutual position of both figure warp threads running above one another, said positions being determined during the weaving process according to a previously defined figure pattern.

More in particular, in the second shed, the positions of the first warp thread and of the second figure warp thread determine said the mentioned mutual position of the above one another running figure warp threads, when they are bound over the weft thread inserted during the first shed.

In a very preferred method according to this invention, the figure warp thread that is positioned in the second shed in the position located nearest to the weft insertion level, takes up the figure shaping position in the fabric when bound over the weft thread that was inserted during the first shed.

In a particular implementation of the method according to the invention, alternately a first and a second shed are applied.

The method according to this invention runs more efficiently when the first and the second figure warp thread on the weaving machine are not separated from each other by a weaving machine element, such as a reed dent or a spacer. Preferably, the first figure warp thread and the second figure warp thread are provided adjacent to each other on the weaving machine.

In another particular implementation of the method according to the invention, per warp thread system, at least one tensioning warp thread is provided and the successive weft threads are provided alternately above and below the tensioning warp threads, so that a fabric with two layers of weft threads is shaped. By providing tensioning warp threads, the successive wefts are positioned in layers above and below these tensioning warp thread, which allows hiding of any additional figure warp threads between these successive wefts without need for extra stem warp threads as is the case in the method with figure shaping weft threads.

In an especially advantageous implementation of the method according to the invention, the first and/or the second figure warp thread remain positioned above or below the weft insertion level for several operating cycles. This allows introducing yet more variation into the figure shape.

In a preferred method according to the invention, at least one warp thread system comprises a group of at least three figure warp threads of a different color or aspect, while the two figure warp threads that, during a number of operating cycles, together are bound into the fabric in a figure shaping manner are selected from this group according to the desired figure pattern at both fabric sides, whereas every other figure warp thread of the group is bound into the fabric in a non-figure-shaping manner during these operating cycles. Such method allows adding additional colors and structures into the fabric.

Preferably, each in non-figure-shaping figure warp thread is bound in the fabric in a stretched manner and running together with a tensioning warp thread.

Addition of a third figure warp thread per warp thread system allows realizing fabrics with two useable sides that allow deviation from the complementary character of the figure pattern at both sides of the fabric. Indeed, with three figure warp threads it is possible to insert either at one side or at the other side an additional (not complementary) figure element at any location in the fabric. This is especially interesting when, for instance, we want to integrate text or logos in the fabric, as such text or logos are to form a different figure at both sides of the fabric in order to be readable. In such case, the text or logo cannot overlap with any text or logos at the other side of the fabric.

The latter is indeed possible in a special method according to this invention in which at least one warp thread system comprises a group of figure warp threads with a first pair of figure warp threads of a first color, structure or aspect and a second pair of figure warp threads of a second color, structure or aspect, and in which the two figure warp threads that, together, are bound into the fabric in a figure shaping manner always belong to the same pair. By this method, we can weave fabrics with two useable sides that are identical on both sides, so that, in this manner, fabrics can be woven that are very resembling to Kelim fabrics.

In another particularly preferred method according to the invention, all figure warp threads of a number of warp thread systems are bound in the fabric in a non-figure-shaping way for a number of operating cycles, so that, at least at one fabric side, at a certain location, the weft threads are visibly bound according to a previously defined figure pattern. By application of this method, yet other additional effects can be realized when shaping the figure. These effects can be realized by one same yarn type for the weft threads, but they can also be realized by inserting different yarn types for the weft threads, for instance, by means of a known weft selector.

A particular method provides that first and second weft threads of a different color or aspect can be inserted in a manner that the weft threads visible at a certain location comprise first as well as second weft threads.

In yet another method according to this invention, per warp thread system, at least one tensioning warp thread is provided and each tensioning warp thread is so positioned in relation to the weft insertion level that, at least at one fabric side, at a certain location, a number of weft threads are visibly bound according to a previously defined figure pattern. This allows additional effects during figure shaping.

Preferably, at least one tensioning warp thread is positioned by means of a jacquard arrangement.

The invention further relates to a method for simultaneous weaving of at least two fabrics on a weaving machine in which, per fabric, a described method according to this invention is applied virtually simultaneously to both fabrics.

The invention also relates to a method for simultaneous weaving of at least two fabrics on a weaving machine having at least a same number of weft insertion devices as there are fabrics to be woven, which are provided to insert weft threads at a respective weft insertion level, while, for each fabric, in successive operating cycles of the weaving machine, in relation to a different weft insertion level, a shed is formed between a number of warp threads of a number of warp thread systems in relation to a different weft insertion level and one weft thread is inserted in each shed, characterized in that, in each shed, the warp threads are positioned in relation to the related weft insertion level in a way that, together with the inserted weft threads, they form a fabric that displays figure shaping warp threads at both sides, and in which, per fabric, at least one warp thread system comprises a first figure warp thread and a second figure warp thread, which, together, are positioned in a number of operating cycles alternately above and below the weft insertion level, so that, at both fabric sides, these warp threads are bound over the same weft threads while running above one another, the upper warp thread being figure shaping at the topside of the fabric and the lower warp thread being figure shaping at the bottom side of the fabric, and in which, in each fabric, the mutual position taken up by the first warp thread and the second warp thread is selectively determined during the weaving process according to a previously defined figure pattern.

By this method, it is possible to produce simultaneously two fabrics with two useable sides. Such weaving machine is preferably a face-to-face weaving machine.

In a particular method for simultaneous weaving of at least two fabrics on a weaving machine according to the invention, for each fabric, a method is applied, in which the mentioned first and second figure warp threads are positioned in a first shed at a first level at one side of the weft insertion level and in a second shed at a different second and a third level at the other side of the weft insertion level, while the positions of the first and the second figure warp thread determine the mentioned mutual position of the two figure warp threads running above one another in the second shed, said positions being determined during the weaving process according to a previously defined figure pattern, and, in relation to two weft insertion levels located above one another, upon positioning of first and second warp threads in the mentioned first and second sheds, the lower level is provided in relation to the upper weft insertion level above the lower weft insertion level.

The lower level in relation to the upper weft insertion level is preferably located above the upper level in relation to the lower weft insertion level. Such system presents the advantage that the warp threads have to cross less often.

In a particularly preferred method for simultaneous weaving of at least two fabrics on a weaving machine according to the invention, the first and second warp threads are located at both the mentioned first level in relation to the upper weft insertion level and the mentioned first level in relation to the lower weft insertion level between the weft insertion devices operating at these weft insertion levels.

In another particularly preferred method for simultaneous weaving of at least two fabrics on a weaving machine, the first and second warp threads are located at both the mentioned second and third levels in relation to the upper weft insertion level and the mentioned second and third levels in relation to the lower weft insertion level between the weft insertion devices operating at these weft insertion levels.

In a particularly advantageous method for simultaneous weaving of at least two fabrics on a weaving machine, in at least one warp thread system at least one figure warp thread is positioned in a way that it is bound alternately over a weft thread of an upper fabric and over a weft thread of a lower fabric, and cut between these fabrics so that on the facing fabric sides respective areas with cut pile are formed. This is particularly interesting because, in this manner, the special additional effect of cut pile is added to one of the fabric sides.

Such fabrics can be used at both sides, for instance, when they are hung up to divide a space in two separate spaces. The mentioned cut pile effect is then visible at on side of the suspended fabric.

Another object of this patent application is a weaving machine comprising shed formation devices provided to form a shed in successive operating cycles between a number of warp threads, and a weft insertion device provided to insert during each operating cycle one weft thread at a weft insertion level in this shed, the shed formation devices being provided to bring two figure warp threads of a same warp thread system in a first operating cycle at a first level at one side of the weft insertion level and to bring these figure warp threads to a different second and third level at the other side of the weft insertion level in a second operating cycle.

With a weaving machine of this kind, we can produce a fabric according to this invention in a particularly efficient manner.

In a preferred embodiment, the weaving machine comprises at least two weft insertion devices provided to insert in each operating cycle one weft thread at a respective weft insertion level, as well as shed formation devices provided to form a shed in successive operating cycles in relation to each weft insertion level, characterized in that, in relation to each weft insertion level, the shed formation devices are provided to bring two figure warp threads of a same warp thread system to a first level at one side of the weft insertion level in a first operating cycle, and to bring both these figure warp threads in a second operating cycle to a different second and third level at the other side of the weft insertion level. Said second and third levels are preferably situated between two weft insertion levels located above one another.

In a more preferred embodiment of a weaving machine according to the invention, said weaving machine is provided to perform alternately a first and a second operating cycle.

In a particular embodiment of a weaving machine according to the invention, the distance between the mentioned second and third level is smaller than the distance between the first level and the second level. As, for performing of the method according to this invention, no weft insertion device must be passed between these two positions that are located along the same side of the weft insertion level (the mentioned second and third level), these positions can be closer to each other that the positions located at either side of the weft insertion level (first and second level).

This can be realized by a jacquard arrangement with more than three positions, of which one position coincides with the weft insertion level and in which this position is not being used. If, in this weaving machine, a distance L is provided between the positions that at both sides are located closest to the weft insertion level (first and second level), then the distance between the two positions located at the same side of the weft insertion level (second and third level) equals L/2.

This can also be realized by a suitable pulley system, possibly in combination with a grid moving in phase or in counter phase together with the driving blades.

In a preferred weaving machine according to this invention the distance between the mentioned second and third level is preferably about one half of the distance between the first and the second level.

To realize this, the weaving machine according to the invention comprises in a preferred embodiment a jacquard arrangement to bring the warp threads to the first level, the second level and the third level. In a preferred embodiment, said jacquard arrangement is a non-open-shed jacquard arrangement, preferably a non-open-shed jacquard arrangement with at least three positions. In a most preferred embodiment, the jacquard arrangement is an open-shed jacquard arrangement, preferably with three or more positions, by which thus at each shot (at each insertion of a weft thread) each one of these three or more positions can be reached.

SUMMARY OF THE INVENTION

This invention relates in particular to a weaving machine provided to apply a method according to this invention.

In a particular embodiment, the weaving machine according to this invention is a weaving machine with at least three grippers with a jacquard arrangement provided to bring the figure warp threads in at least three positions. With such a weaving machine, three fabrics with two useable sides can be woven simultaneously according to this invention. The jacquard heddles for the figure warp threads of one or more of these fabrics can perform the same movements as the figure warp threads of another one of these fabrics, but these movements are separated in height in relation to each other. These height separations can be set, for instance during equalization of the harness.

When weaving three fabrics one above the other, the weaving machine construction must be adapted to include three cloth evacuation and cloth winding systems or, for instance, two of the three cloths must together be evacuated and wound.

This invention further relates to a fabric that comprises a series of weft threads interwoven with warp threads and that displays on both sides figure shaping warp threads, in which the fabric comprises a first figure warp thread and a second figure warp thread together running alternately above and below one or more weft threads, so that, at both fabric sides, these figure warp threads are bound over the same weft threads, while running above one another, whilst the upper figure warp thread is figure shaping at the topside of the fabric and the lower figure warp thread is figure shaping at the bottom side of the fabric, and in which the mutual position taken up in the fabric by the first figure warp thread and the second figure warp thread changes according to the position in the fabric so that a drawing, figure or pattern is obtained at both fabric sides.

Of course, such a fabric can be provided with ground warp threads to realize the desired binding structure for the weft threads.

In a preferred embodiment of the fabric according to the invention, said fabric comprises tensioning warp threads, while the successive weft threads are provided alternately above and below the tensioning warp threads, so that the fabric comprises two layers of weft threads. Preferably, the fabric comprises figure warp threads that are bound in a non-figure-shaping way in the fabric.

In a more preferred embodiment of the fabric according to the invention, the fabric comprises at least one warp thread system with groups of figure warp threads, in which each group comprises a first pair of figure warp threads of a first color, structure or aspect and a second pair of figure warp threads of a second color, structure or aspect, and the two figure warp threads that together are bound in a figure shaping way in the fabric always belong to the same pair, so that a virtually identical figure, drawing or pattern is obtained at both fabric sides. This fabric strongly resembles the aspect of Kelim fabrics.

In a particularly preferred embodiment of the fabric according to the invention, the fabric comprises weft threads that, at least at one fabric side, are bound visibly in a certain location. Preferably, the fabric comprises first and second weft threads of a different color or aspect, and the weft threads that are visible at a certain location comprise both first and second weft threads.

In what follows, the method according to this invention is further explained and a number of preferred methods and fabrics are described in detail by way of examples. The sole purpose of this is to further clarify the general principles and the mentioned characteristics and advantages of the invention by means of a number of concrete examples. It should thus be clear that nothing in this description may be interpreted as a limitation of the extent of the requested patent rights as set forth in the claims or as a limitation of the field of applicability of this invention.

BRIEF DESCRIPTION OF THE DRAWINGS

In the description that follows, reference is made by means of figures to the enclosed drawings, in which:

FIGS. 1*a* and 1*b*, 3*a* and 3*b*, 7*a* and 7*b*, 10*a* and 10*b*, 11*a* and 1*b*, 12*a* and 12*b*, 13*a* and 13*b*, 14*a* and 14*b*, 15*a* and 15*b*, and 16*a* and 16*b* represent cross sections in warp direction of fabrics (W1), (W2) during their production according to a method according to this invention, in which figures, for each fabric, each time the warp threads (1–5) of one warp thread system and a series of weft threads (6) are shown, whereas in the figures of which the sequence number is followed by the letter a, the figure shaping figure warp threads (1), (2) at the height of each weft thread (6) are shown at their respective positions that they take in the shed that is formed at the insertion of this weft thread (6), and whereas in the figures of which the sequence number is followed by the letter b, the figure shaping warp threads (1), (2) are shown at their respective positions that they take in the fabrics, and in which FIGS. 1*a* and 1*b* represent simultaneously woven fabrics, with application of a shed formation according to FIG. 9;

FIGS. 3*a* and 3*b* represent a single woven fabric with floating figure warp threads FIGS. 7*a* and 7*b* represent simultaneously woven fabrics, with application of a shed formation according to FIG. 6;

FIGS. 10*a* and 10*b* represent simultaneously woven fabrics with floating figure warp threads;

FIGS. 11*a* and 11*b* represent simultaneously woven fabrics with hidden bound in figure warp threads;

FIGS. 12*a* and 12*b* represent simultaneously woven fabrics with identical figure shaping at both sides;

FIGS. 13*a* and 13*b* represent simultaneously woven fabrics with an area with pile formation;

FIGS. 14*a* and 14*b* represent simultaneously woven fabrics with weft threads that are visibly bound by having the figure warp threads run with the tensioning warp threads;

FIGS. 15*a* and 15*b* represent simultaneously woven fabrics with weft threads that are visibly bound by positioning the tensioning warp yarns by means of the jacquard arrangement; and FIGS. 16*a* and 16*b* represent simultaneously woven fabrics without tensioning warp threads.

DETAILED DESCRIPTION OF THE PREFERRED EMBODIMENTS

Figure 1A:
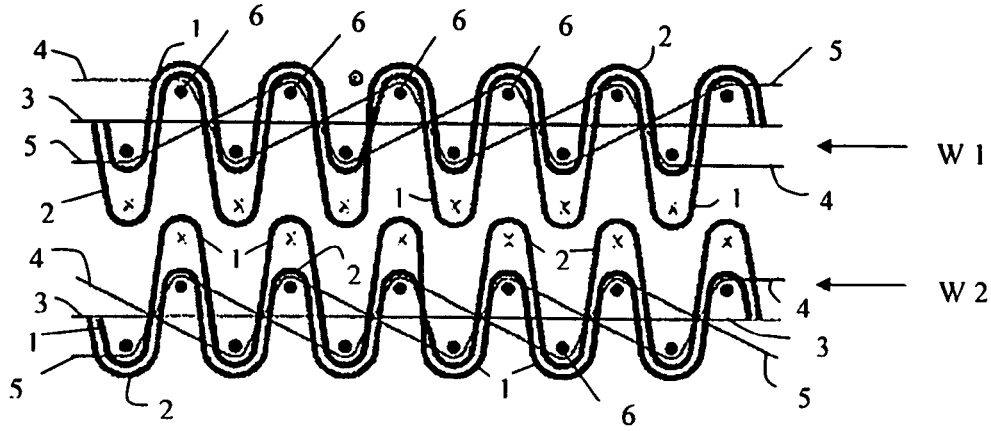
Figure 1B:
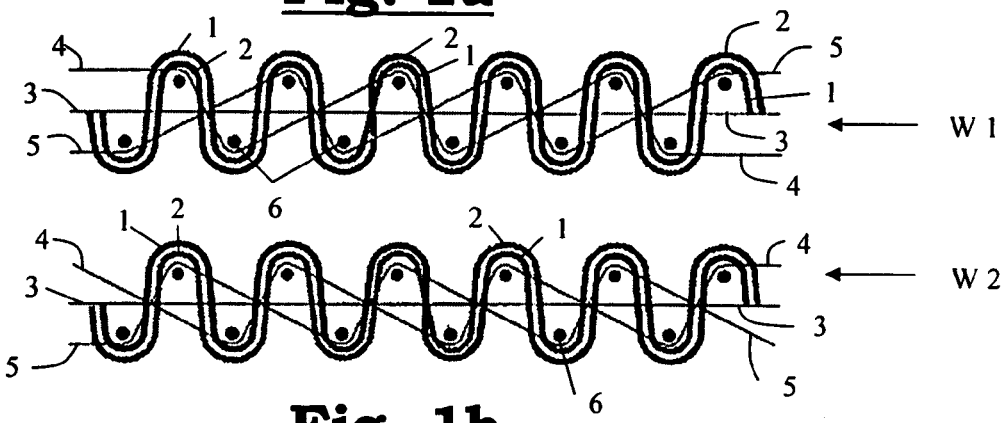

At the application of the method according to the invention illustrated by FIGS. 1*a* and 1*b*, two fabrics (W1), (W2) are woven simultaneously on a weaving machine with two grippers (7), (8). For this, each fabric (W1), (W2) is provided with a series of warp thread systems. Each warp thread system comprises a first figure warp thread (1), a second figure warp thread (2), a tensioning warp thread (3) and a system of two binding warp threads (4), (5) working together. In successive operating cycles of the weaving machine, each time a respective shed is formed between the warp threads (1–5) of the warp thread systems for the upper fabric (W1) as well as between the warp threads of the warp thread systems for the lower fabric (W2). In each operating cycle, two weft threads (6) are inserted at a respective weft insertion level. The upper weft thread (6) is inserted in the shed between the warp threads (1–5) for the upper fabric (W1). The lower weft thread (6) is inserted in the shed between the warp threads (1–5) for the lower fabric (W2).

In each shed, the binding warp threads (4), (5) and the tensioning warp thread (3) of these warp thread systems are positioned in relation to the respective weft insertion levels in a way that the successive weft threads (6) run alternately above and below the stretched tensioning warp thread (3) and that both binding warp threads (4), (5) run mutually in counter phase alternately above and below two successive weft threads (6), so that these binding warp threads repeatedly cross each other and each time bind two weft threads (6) at both sides of the tensioning warp thread (3) in the openings between their crossing points.

In the successive operating cycles, in each warp thread system, the two figure warp threads (1), (2) are positioned together, alternately above and below the weft insertion level, so that at both fabric sides these figure warp threads (1), (2) are yarned over the same weft threads (6) while running above one another, the upper figure warp thread (1), (2) being figure shaping at the topside of the fabric (W1), (W2) and the lower figure warp thread (1), (2) being figure shaping at the bottom side of the fabric (W1), (W2). According to this invention, the mutual position (upper and lower position) taken up in the fabric (W1), (W2) by the first figure warp thread (1) and by the second figure warp thread (2) is selectively determined according to a previously defined figure pattern.

To do so, in a first operating cycle of the weaving machine, the first figure warp threads (1) and the second figure warp threads (2) (see FIG. 9) are positioned at a first level (POS. 1) at one side of the weft insertion level. In a thereupon following second operating cycle, these figure warp threads (1), (2) are positioned at a different second (POS. 2) and third level (POS. 3) at the other side of the weft insertion level. By purposeful selection of the positions (POS. 2; POS. 3) of the first (1) and the second figure warp thread (2) in this second operating cycle, we can determine the mutual position (upper or lower position) that the two figure warp threads (1), (2) will take up in the fabric (W1), (W2). This mutual position is determined according to a desired figure pattern. The figure warp thread (1), (2) that has to be figure shaping along the topside of the fabric (W1), (W2) must take the upper position in the fabric. The figure warp thread (1), (2) that has to be figure shaping along the bottom side of the fabric (W1), (W2) must take the lower position in the fabric (W1), (W2).

When, in a first shed (I) (see FIG. 2), both figure warp threads (1), (2) are brought together at a same position (POS. 1), after which a first weft thread (6) is inserted in this shed (I) and beaten up against the fabric edge, the mutual position of these figure warp threads (1), (2) is in all evidence still undetermined at that moment. Only when a subsequent (second) weft thread (6), which was inserted in the following shed (II), is beaten up against the fabric edge, the mutual position of the two figure warp threads (1), (2) will be determined in relation to the first weft thread (6).

It was also observed that, by inserting the two figure warp threads (1), (2) in this second shed (II) at a different level (POS. 2), (POS. 3), the warp threads (1), (2) take a well-defined mutual position in relation to the first weft thread (6), whereas the warp thread (1), (2) inserted in the second shed (II) in the position (POS. 3) located furthest away from the weft insertion level will position itself against the first weft thread (6), and the warp thread (2), (1) inserted in the second shed (II) in position (POS. 2) located nearest to the weft insertion level will be bound over the other figure warp thread (1), (2) while running around the first weft thread (6). The latter figure warp thread (1), (2) will thus be figure shaping at the first weft thread (6).

As, in this second shed (II), the figure warp threads (1), (2) are brought to a different level (POS. 2), (POS. 3), their mutual position is indeed already determined during this shed formation, so that this mutual position is maintained. Obviously, the figure warp thread positioned in the position (POS. 3) located furthest away from the weft insertion level is the figure shaping figure warp thread (1), (2). This state is secured by a subsequent weft thread (6).

For instance, if we consider the upper fabric (W1) of FIGS. 1*a* and 1*b*, we see that, upon being bound over the first five weft threads (6), the figure warp threads (1), (2) take up a same mutual position, and we see that this mutual position is switched between the fifth and sixth weft thread (6). After this switch, the figure warp thread (2) that, at first, was figure shaping at the bottom side of the fabric (W1) will be figure shaping as of the sixth weft thread (6) at the top side of the fabric whilst the figure warp thread (1) that, at first, was figure shaping was at the top side of the fabric (W1) will be figure shaping as of the sixth weft thread (6) at the bottom side of the fabric.

At the insertion of the first, third and fifth weft thread (6), each time the same (first) figure warp thread (1) is brought in the position (POS. 2) located nearest to the weft insertion level, so that, at the top side of the fabric (W1), this first figure warp thread (1) is figure shaping over the second (6) and the fourth weft thread (6). The other (second) figure warp thread (2) is figure shaping (W1) over the first, third and fifth weft thread (6) at the bottom side of the fabric.

At the insertion of the seventh weft thread (6), the second figure warp thread (2) is brought in the position (POS. 2) located nearest to the weft insertion level. When the sixth weft thread (6) was inserted, the mutual position of the figure warp threads (1), (2) was still undetermined. By the changed position of these figure warp threads (1), (2) in the shed for the seventh weft thread (6), now, also their mutual position at the sixth weft thread (6) is determined. As of the sixth weft thread (6), the second figure warp thread (2) becomes figure shaping at the top side of the fabric (W1), while, as of the sixth weft thread (6), the first figure warp thread (1) becomes figure shaping at the bottom side of the fabric (W1). The switch of the mutual position of the two figure warp threads (1), (2) takes thus place between the fifth weft thread (6) and the sixth weft thread (6).

Figure 2:
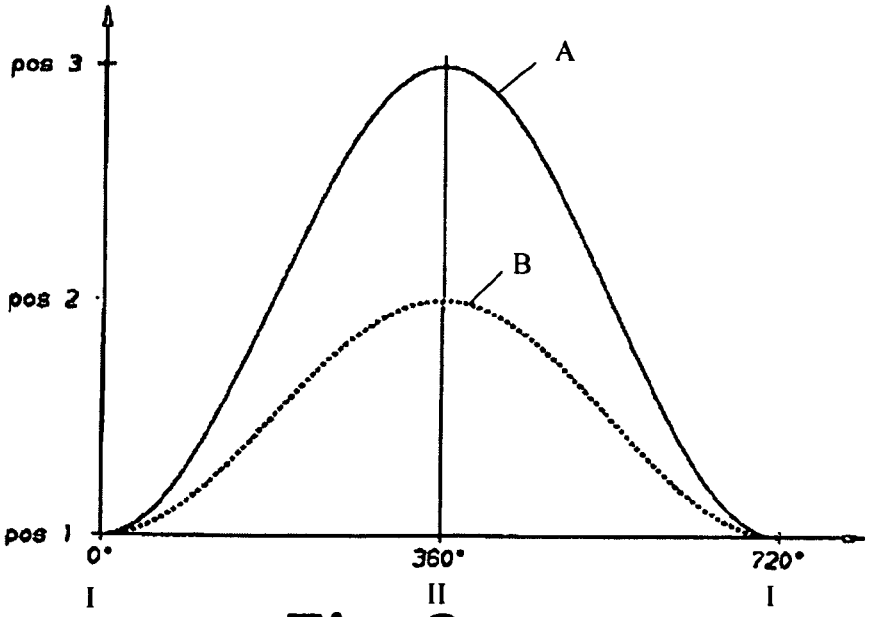
FIG. 2 represents the positioning of the first and second figure warp threads during three successive shed formations.

In FIG. 2, the position changes of the first (1) and second figure warp threads (2) are indicated in three successive sheds (I, II, I), by means of respectively a continuous line (A) and a dotted line (B). At a first shed formation (at 0°) a shed (I) is formed, in which the first figure warp thread (1) and the second figure warp thread (2) are brought at a same first position (POS. 1).

At a second shed formation (at a 360° turn of the main shaft of the weaving machine), a shed (II) is formed, in which the first figure warp thread (1) and the second figure warp thread (2) are brought respectively in a third position (POS. 3) and a second position (POS. 2). The first figure warp thread (1) is brought from the first position (POS. 1) to the third position (POS. 3), located furthest away from the weft insertion level (see continuous line (A) in FIG. 2). The second figure warp thread (2) is brought from the first position (POS. 1) to the second position (POS. 2), located nearest to the weft insertion level (see dotted line (B) in FIG. 2).

At a third shed formation (at 720°), a same shed (I) is formed as at the first shed formation (at 0°). The two figure warp threads (1), (2) are then brought again in the same position (POS. 1). Because of the mutual positions (POS. 3, POS. 2) of figure warp threads 1 and 2 at 360°, at the shed formation at 0°, weft thread 2 will come to be positioned under weft thread 1. By applying alternately a first (I) and a second shed (II), a fabric can be shaped as presented in FIGS. 1*a* and 1*b*.

Figure 6:
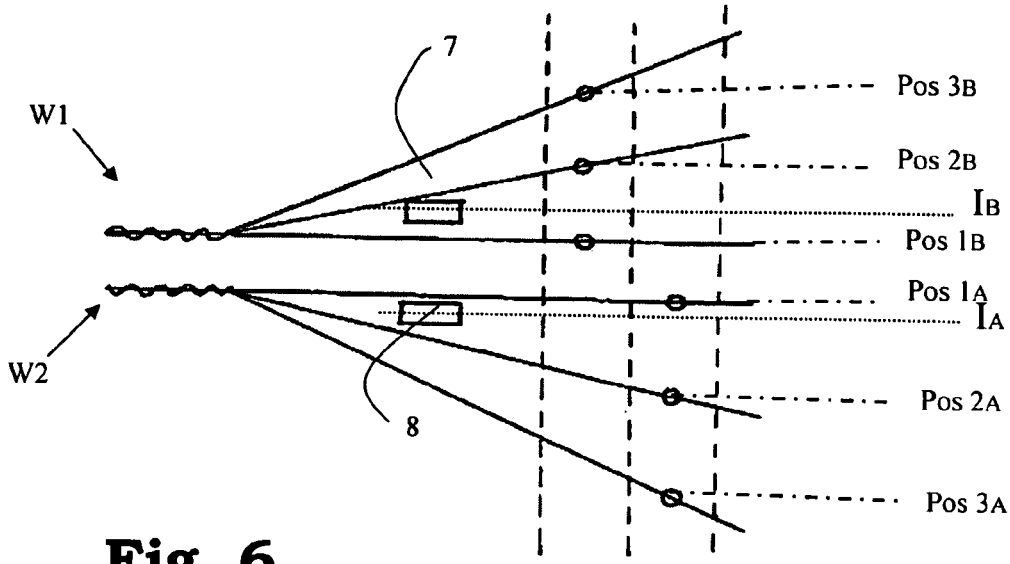
FIG. 6 represents a first shed formation realizable with a three-position jacquard machine when weaving a fabric according to the invention as represented in FIGS. 7*a* and 7*b;*
Figure 9:
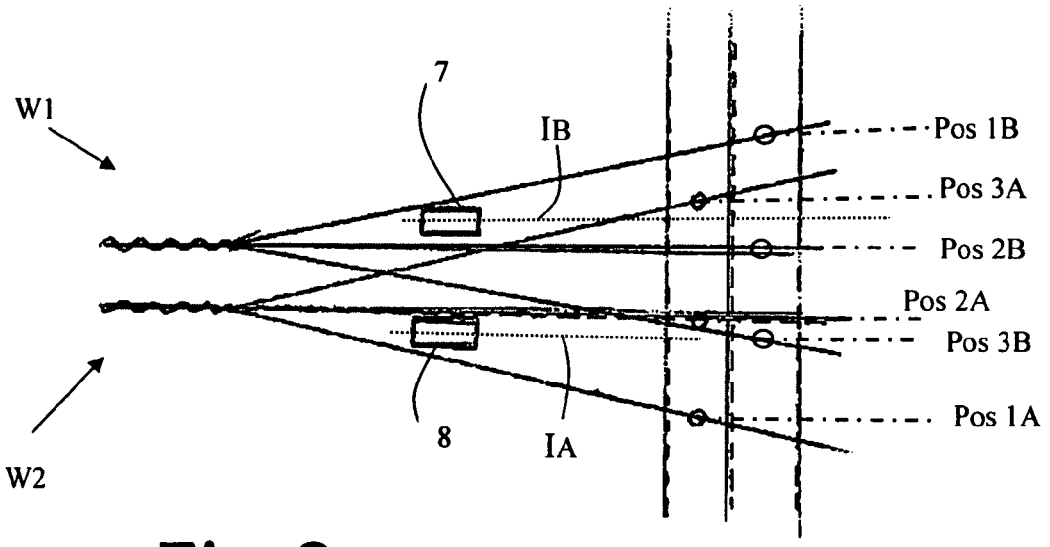
FIG. 9 represents a second shed formation realizable with a three-position jacquard machine when weaving a fabric according to the invention as represented in FIGS. 1*a* and 1*b*; 10*a* and 10*b*; 11*a* and 11*b*; 12*a* and 12*b*; 13*a* and 13*b*; 14*a* and 14*b*; 15*a* and 15*b*; 16*a* and 16*b*.

This method is performed on a face-to-face weaving machine with two grippers (7), (8), provided to insert weft threads (6) on weft insertion levels (IB), (IA) situated one above the other (see FIGS. 6 and 9). The weaving machine also comprises a three-position jacquard machine to position the figure warp threads (1), (2) at three different levels. Positioning of the figure warp threads (1), (2) for the upper fabric (W1) in three positions in relation to the upper weft insertion device must be possible, whereas positioning of the figure warp threads (1), (2) for the lower fabric (W2) in three positions in relation to the lower weft insertion device must also be possible. In what follows, these three positions per weft insertion device will be called the upper, the middle and the lower position.

Figure 3A:
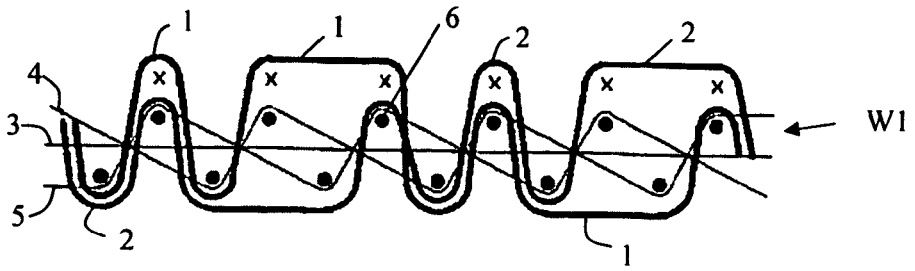
Figure 3B:
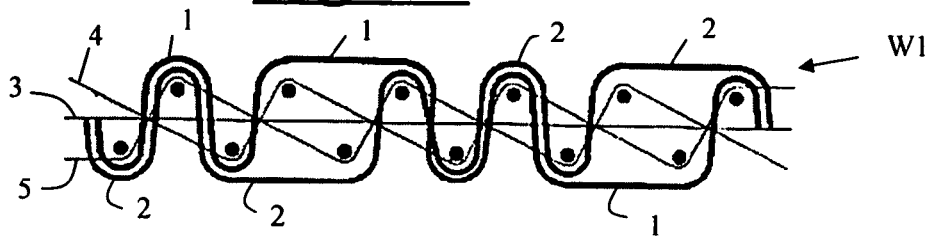

According to this invention, also fabrics can be produced of which the figure warp threads (1), (2) float over several weft threads (6) on the surface of the fabric (W1), (W2), and this both at the top side and the bottom side of the fabric. A fabric like this is represented as a singly woven fabric in FIGS. 3*a* and 3*b*. To weave such fabrics, a shed formation is applied that corresponds with the shed formation in relation to the upper gripper (7) in FIG. 6. For this fabric (W1) for instance, at the insertion of the fourth, fifth and sixth weft thread (6) and at the insertion of the tenth, eleventh and twelfth weft thread (6), the first figure warp thread (1) is held in the upper position (POS. 3B) in relation to the unique weft insertion level (IB) in the successive sheds. At the insertion of the fourth, fifth and sixth weft thread (6) and at the insertion of the tenth, eleventh and twelfth weft thread (6), the second figure warp thread (2) is held in the lower position (POS. 1B) in relation to the unique weft insertion level (IB). This allows realizing special figures and effects.

Figure 4:
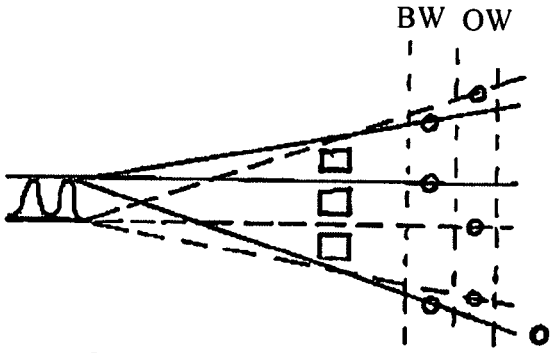
FIG. 4 represents a shed formation realizable with a three-position non-open-shed jacquard machine when weaving a face-to-face pile fabric according to the prior art.
Figure 5A:
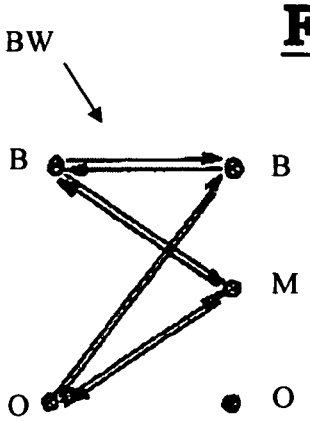
FIGS. 5*a* and 5*b* represent the possible movements of the jacquard heddles with a three-position non-open-shed jacquard machine when weaving a face-to-face pile fabric according to the prior art, respectively for the upper fabric and the lower fabric.
Figure 5B:
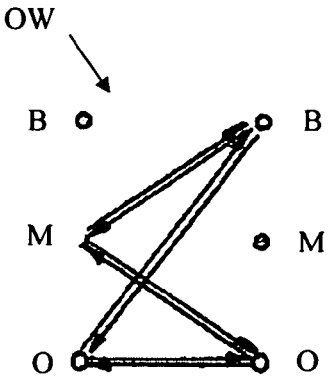

The jacquard machine can be either a non-open-shed jacquard machine or an open-shed jacquard machine. FIG. 4 shows a shed formation with a known three-gripper weaving machine for face-to-face weaving of fabrics with cut pile with a three-position jacquard arrangement with moveable grid for the lower fabric (OW) and a fixed grid for the upper fabric (BW). FIG. 4 also indicated the possible positions: upper (B), middle (M) and lower (O), for the jacquard heddles for the figure warp threads of the upper fabric (BW) as well as for the jacquard heddles for the figure warp threads of the lower fabric (OW). For these jacquard arrangements, FIGS. 5*a* and 5*b* show the movements between the three positions (B), (M), (O) of the jacquard heddles (at even and odd shot) that are necessary to weave a face-to-face pile fabric, respectively for the upper fabric (FIG. 5*a*) and for the lower fabric (FIG. 5*b*). With such system, the method according to this invention can be applied after adjustment of the movements to arrive at a shed formation as shown in FIG. 6.

As can clearly be seen in FIG. 6, the upper position (POS. 3B) and the middle position (POS. 2B) in relation to the upper weft insertion level (IB) are provided above the weft insertion level (IB), whereas the lower position (POS. 1B) is located between the upper weft insertion level (IB) and the lower weft insertion level (IA). In relation to the lower weft insertion level (IA), the upper position (POS. 1A) is also provided between the upper weft insertion level (IB) and the lower weft insertion level (IA), and the middle (POS. 2A) and lower positions (POS. 3A) are provided below the lower weft insertion level (IA). The lower position (POS. 1B) in relation to the upper weft insertion level (IB) is located above the upper position (POS. 1A) in relation to the lower weft insertion level (IA).

Figure 7A:
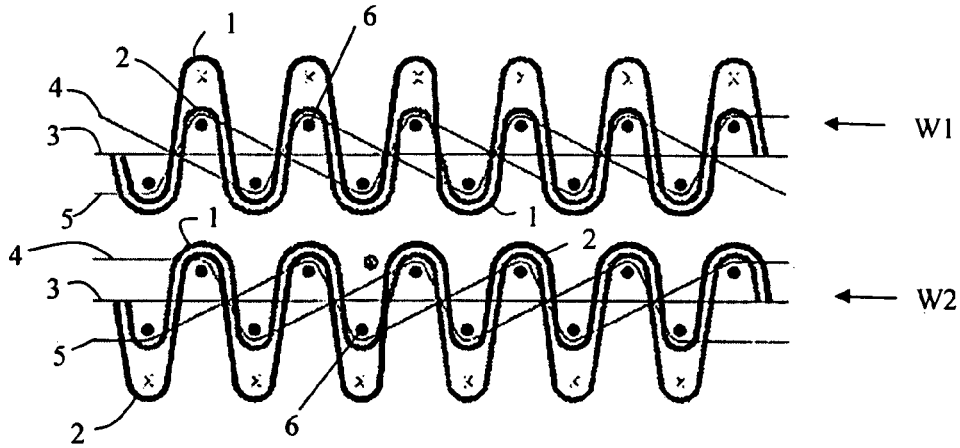
Figure 7B:
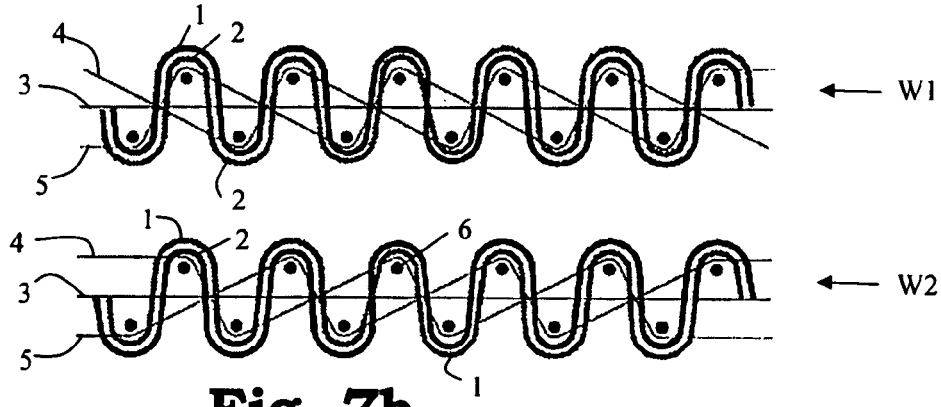

With a face-to-face weaving machine with a three-position jacquard machine set according to FIG. 6, fabrics can be woven according to FIGS. 7*a* and 7*b*.

However, the disadvantage of such system is that the total shed for the upper fabric (W1) and the lower fabric (W2) is quite significant. This causes disadvantages for the passage of the warp threads through the weaving machine. As the angle between the warp threads and the heddles of the jacquard arrangement is relatively large, the component of the tensioning force, which must be compensated by the pull back spring, is also quite significant, so that heavier springs must be used. This results in a higher hook load on the hooks of the jacquard machine.

Figure 8A:
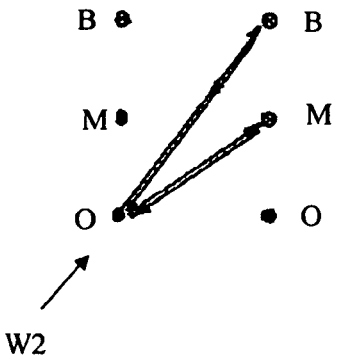
FIGS. 8*a* and 8*b* represent the required movements of the jacquard heddles with a three-position non-open-shed jacquard machine when weaving a fabric according to the invention as represented in FIGS. 1*a* and 1*b* and 16*a* and 16*b;*

To weave a fabric according to FIGS. 1*a* and 1*b*, the jacquard heddles for positioning of the figure warp threads (1), (2) must be capable of performing the following movements in the lower fabric (W2) (see FIG. 8*a*)

i) When the first figure warp thread (1) and the second figure warp thread (2) maintain their mutual position:
- for the first figure warp thread (1)
  - after the odd shot
    - from the lower (O) position to the upper (B) position
  - after the even shot
    - from the upper (B) position to the lower (O) position
- for the second figure warp thread (2)
  - after the odd shot
    - from the lower (O) position to the middle (M) position
  - after the even shot
    - from the middle (M) position to the lower (O) position ii) To switch the mutual position of the first figure warp thread (1) and the second figure warp thread (2):
- for the first figure warp thread (1)
  - after the even shot
    - from the upper (B) position to the lower (O) position
  - after the odd shot
    - from the lower (O) position to the middle (M) position
- for the second figure warp thread (2)
  - after the even shot
    - from the middle (M) position to the lower (O) position
  - after the odd shot
    - from the lower (O) position to the upper (B) position These movement features (see FIG. 8*a*) required to shape the lower fabric (W2) according to FIGS. 1*a* and 1*b* can be obtained by means of the harness setting for the upper fabric (BW) with a three-position non-open-shed jacquard machine for weaving of a face-to-face pile fabric with cut pile (see FIG. 5*a*).

Figure 8B:
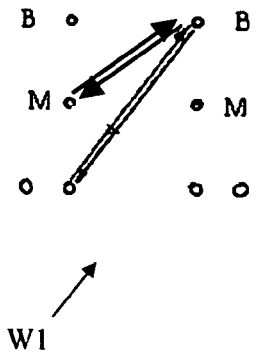

To weave a fabric according to FIGS. 1*a* and 1*b*, the jacquard heddles for positioning of the figure warp threads (1), (2) must be capable of performing the following movements in the upper fabric (W1) (see FIG. 8*b*)

i) When the first figure warp thread (1) and the second figure warp thread (2) maintain their mutual position:
- for the second figure warp thread (2)
  - after the odd shot
    - from the lower (O) position to the upper (B) position
  - after the even shot
    - from the upper (B) position to the lower (O) position
- for the first figure warp thread (1)
  - after the odd shot
    - from the middle (M) position to the upper (B) position
  - after the even shot
    - from the upper (B) position to the middle (M) position ii) To exchange the mutual position of the first figure warp thread (1) and the second figure warp thread (2):
- for the second figure warp thread (2)
  - after the odd shot
    - from the lower (O) position to the upper (B) position
  - after the even shot
    - from the upper (B) position to the middle (M) position for the first figure warp thread (1)

after the odd shot from the middle (M) position to the upper (B) position after the even shot from the upper (B) position to the lower (O) position These movement features (see FIG. 8*b*) required to shape the upper fabric (W1) according to FIGS. 1*a* and 1*b* can be obtained by means of the harness setting for the lower fabric (OW) with a three-position non-open-shed jacquard machine for weaving of a face-to-face pile fabric with cut pile (see FIG. 5*b*).

From what is said above, we can see that the harness setting for the upper fabric (BW) and the lower fabric (OW) with a three-position non-open-shed jacquard machine (with mobile grid) for weaving of a face-to-face pile fabric with cut pile (see FIGS. 4, 5*a* and 5*b*) can be used for weaving of the lower fabric (W2), respectively the upper fabric (W1) according to this invention. The harness part for the upper fabric (BW) and the harness part for the lower fabric (OW) are just to be switched.

With such three-position non-open-shed jacquard machine, a shed formation according to FIG. 9 can be realized without the mentioned disadvantages of a shed formation according to FIG. 6.

In addition, weaving with a jacquard arrangement of the open shed type also offers the possibility to realize additional effects in fabrics with two useable sides (W1), (W2), and this for single-piece weaving as well as for face-to-face weaving.

Figure 10A:
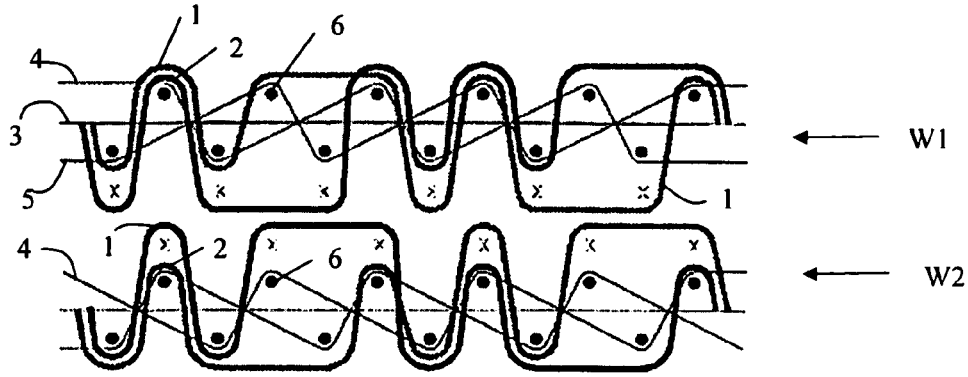
Figure 10B:
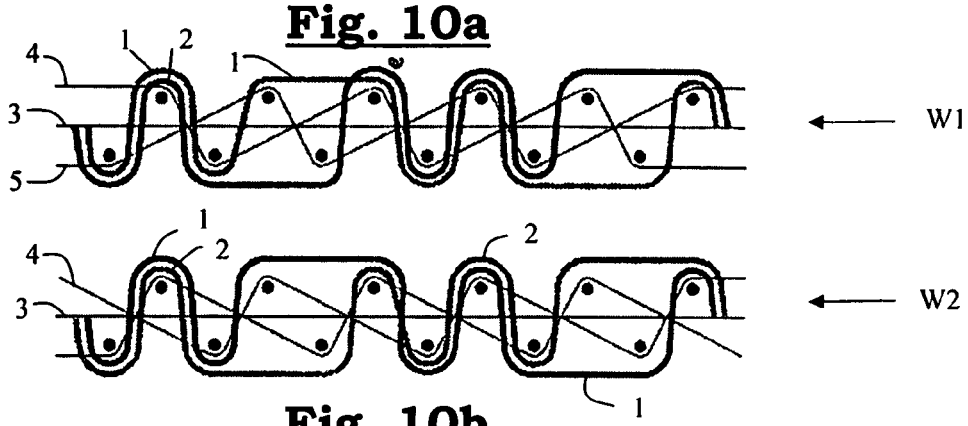

For instance, we can have one or more figure warp threads (1), (2) float over several weft threads (6), both at the top side and the bottom side of the fabric. These figure warp threads then remain figure shaping over a greater length. Such fabrics (W1), (W2) are shown in FIGS. 10*a* and 10*b*. This is possible because, with the mentioned open-shed jacquard arrangements, the figure shaping warp yarns can be held in both extreme positions (upper and lower) for several operating cycles.

Figure 11A:
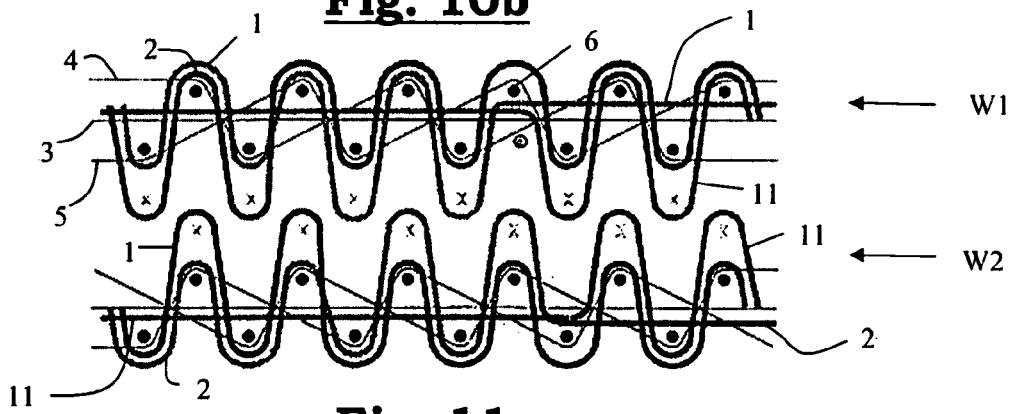
Figure 11B:
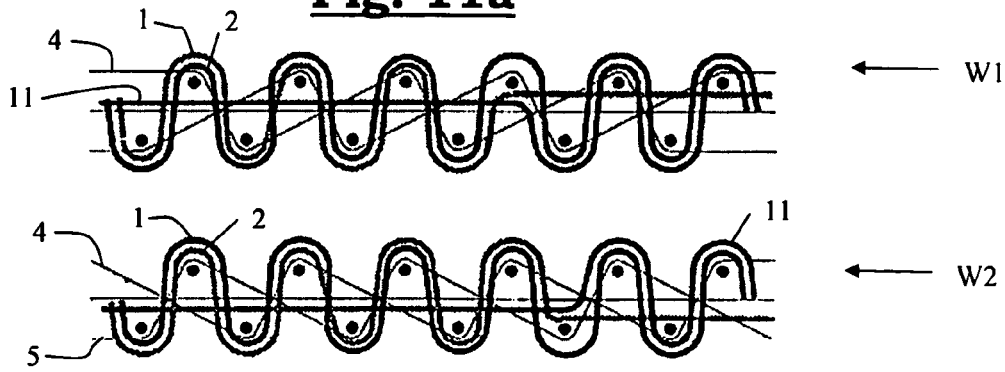

Additionally, per warp thread system, at least one additional warp thread (11) with other properties (color, structure) can be provided (see FIGS. 11*a* and 11*b*). When this figure warp thread (11) is not figure shaping, it is positioned in the successive sheds in a way that it runs stretched together with the tensioning warp thread (3) and remains hidden between the weft threads as well as between the other figure shaping figure warp threads (1), (2). Moreover, each additional figure warp thread (11) can switch with one of the figure shaping warp threads (1), (2) so as to become itself figure shaping, while at the same moment one or both previously figure shaping warp threads (1), (2) will stretch along the tensioning warp thread (3) and be hidden between weft threads and the newly figure shaping warp threads. This allows even more figure shaping in the fabric according to the invention by introducing more colors and structures in the fabric. This becomes possible because, with a jacquard arrangement of the open-shed type, which at each shot can reach all positions, also the required successive positions can be realized in order to have these warp threads (1), (2), (11) run together with the tensioning warp thread (3).

Addition of a third figure shaping warp thread per warp thread system allows realization of fabrics with two useable sides (W1), (W2) in which can be deviated from the complementary character of the figure pattern at both sides of the fabric. With three figure warp threads (1), (2), (11), it is possible to insert an additional (not complementary) figure element at each location in the fabric (W1), (W2), either at one side or at the other side. This is particularly interesting when, for instance, we want to integrate text or logos in the fabric, as such text or logos must be different at both sides of the fabric in order to be readable. In this case, the text or the logo cannot overlap with text or logos at the other side of the fabric.

As of four figure warp threads (1), (2), (11), (12) per warp thread system (see FIGS. 12*a* and 12*b*), any random figure can be made at both sides of the fabric (W1), (W2). Each figure warp thread (1), (2), (11), (12) can be figure shaping at a certain location in the fabric at only one fabric side, but, at that moment, at least 3 other figure warp threads remain available for figure shaping at the other fabric side.

Figure 12A:
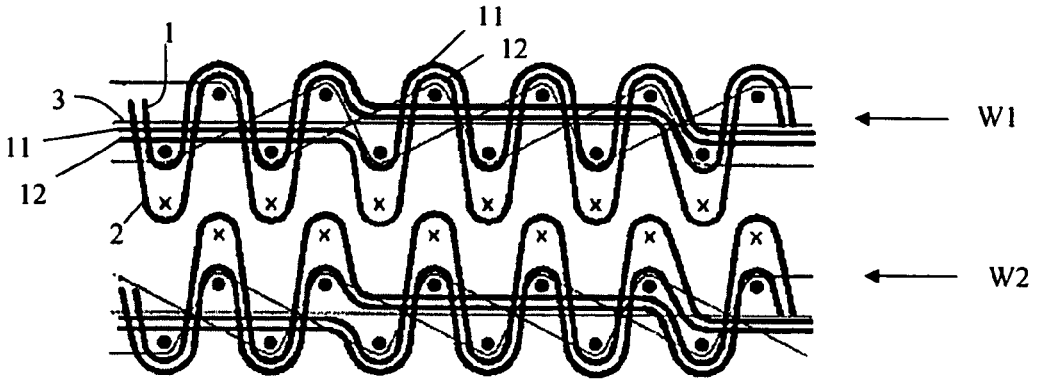
Figure 12B:
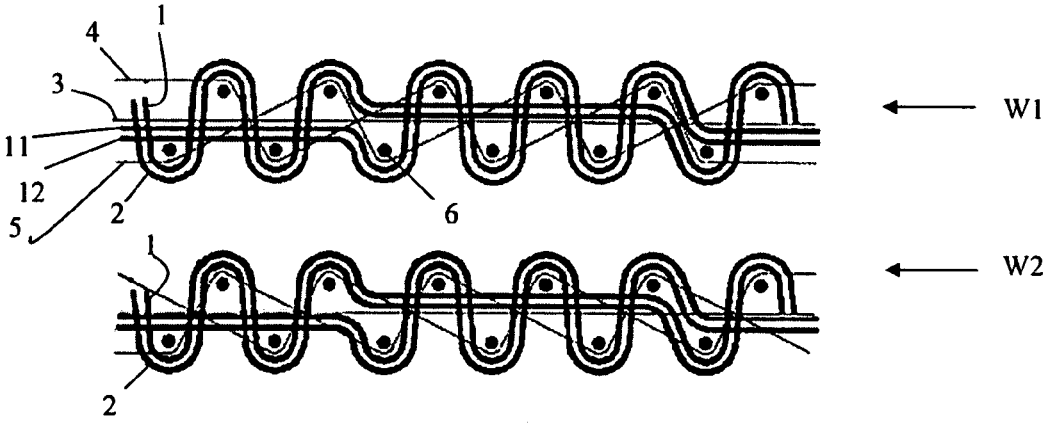

If we provide at least two pairs of identical figure warp threads (1), (2); (11), (12) per warp thread system, we can shape figures simultaneously at both sides of the fabric with an identical figure shaping warp thread (1), (2), (11), (12). In this manner, also fabrics with two useable sides (W1), (W2), which are identical at both sides can be woven, so that fabrics can be woven that strongly resemble the aspect of Kelim fabrics. Such fabrics are shown in FIGS. 12*a* and 12*b*.

In this manner it becomes also possible to integrate text or logos that are different at both sides and that overlap with the text and logo on the other side.

Figure 13A:
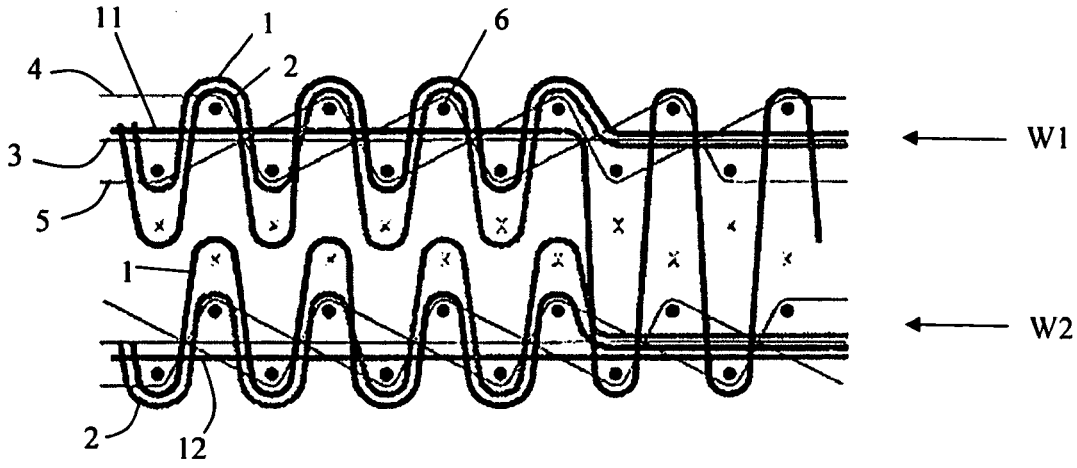
Figure 13B:
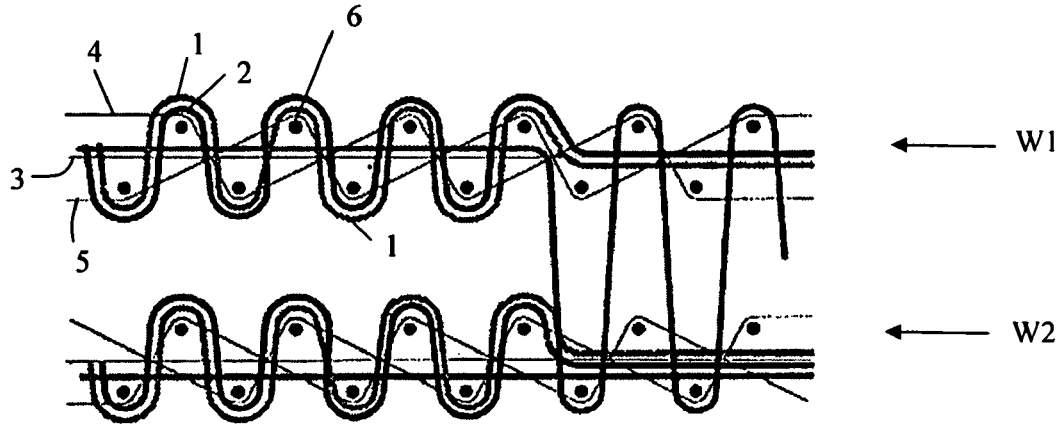

When performing face-to-face weaving of double-sided fabrics (W1), (W2) according to the method as described above, with a four-position jacquard arrangement of the open-shed type, it is also possible to shape an area with cut piles on the facing sides of both fabrics (W1), (W2). Such fabrics (W1), (W2) are shown in FIGS. 13*a* and 13*b*. This additional pile effect can be interesting for instance for fabrics hung up as partitions where said pile effect will be visible at one side of the partition.

Figure 14A:
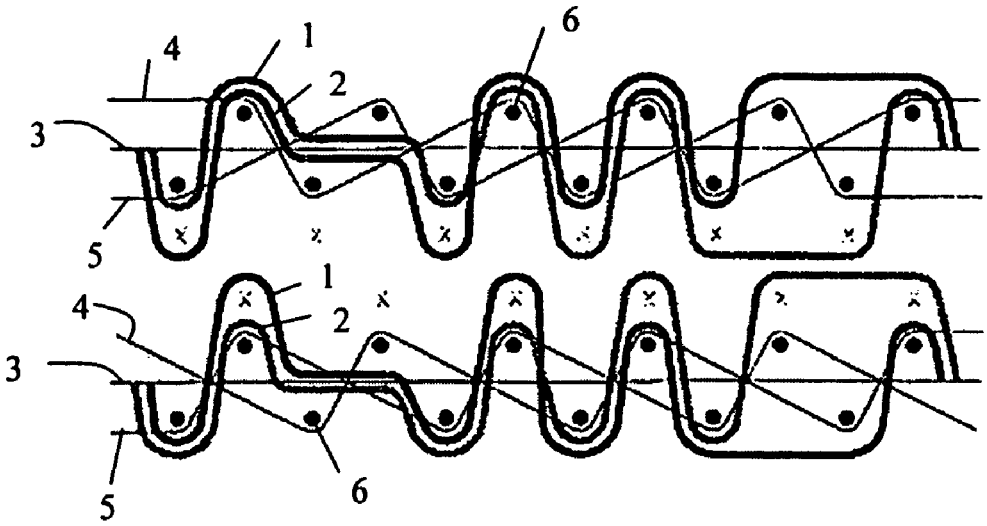
Figure 14B:
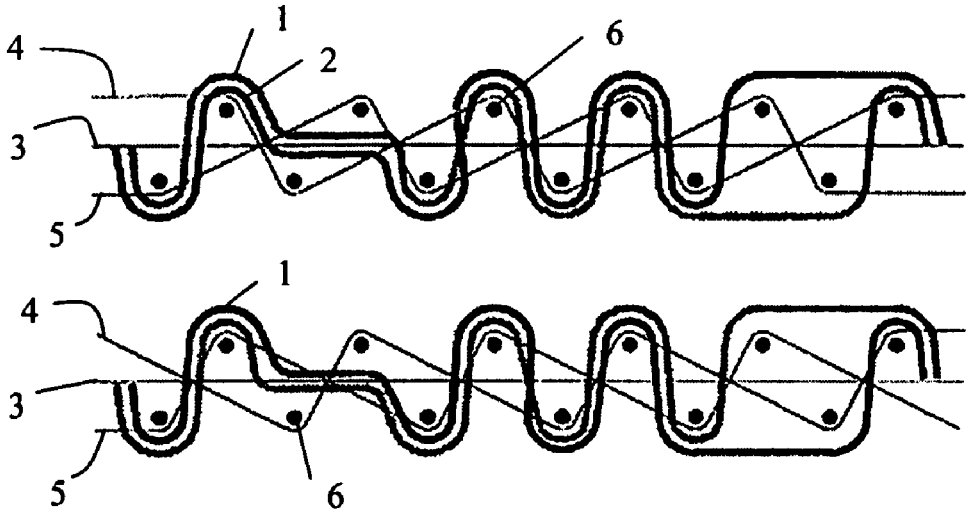

Additionally, according to this method, we also can realize additional figure effects by having all figure warp threads (1), (2) at a certain location run together with the tensioning warp thread (3) for one or more operating cycles, so that the weft threads (6) that are inserted during these cycles become visible at the outer side of the fabric (W1), (W2) at that location. Such fabrics (W1), (W2) are shown in FIGS. 14*a* and 14*b*, where we see that from the left side onward, the forth weft thread (6) is visible at some location at the top side of the fabrics (W1), (W2), as the figure warp threads (1), (2) run together with the tensioning warp thread (3) at that location. These effects can be realized with a same yarn type for the weft threads (6), but they can also be realized by different yarn types (of a different color or structure), by introducing a known weft selector.

Figure 15A:
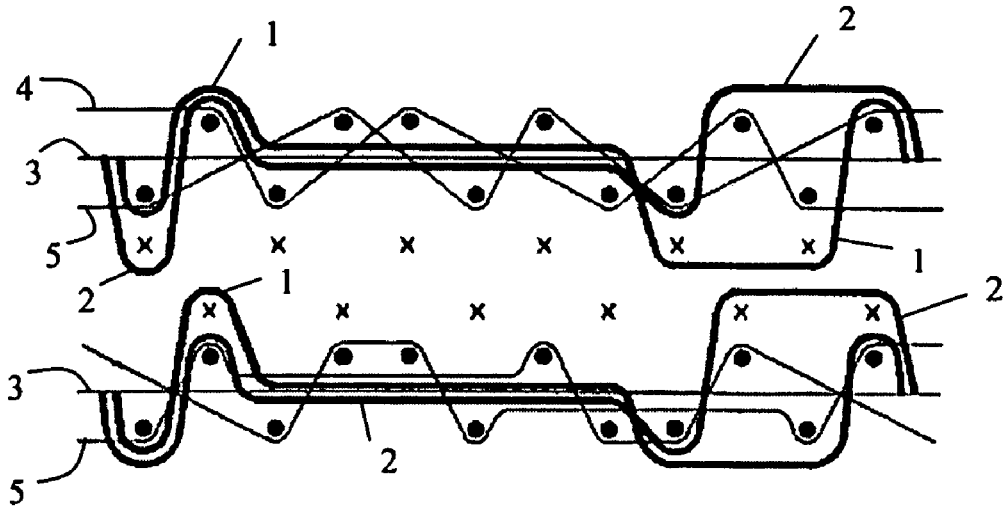
Figure 15B:
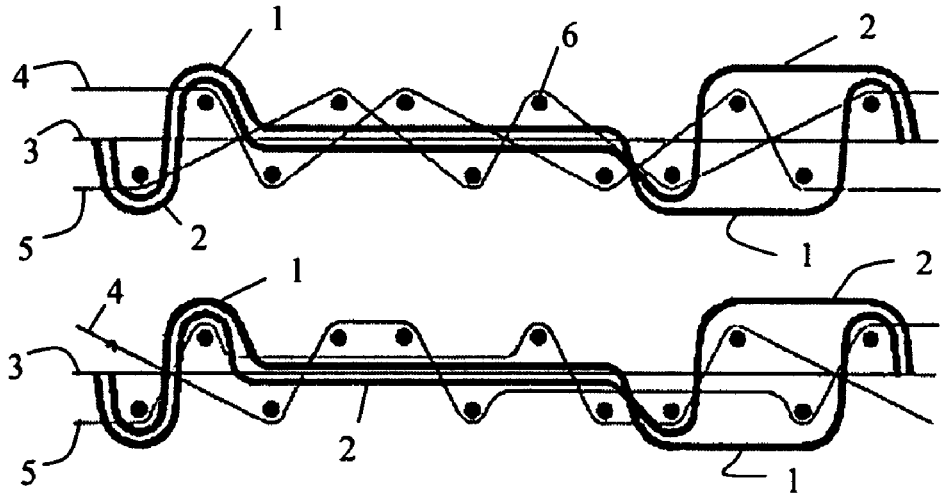

To realize yet other effects in the fabrics according to the invention, we can opt (see FIGS. 15*a* and 15*b*) not to realize any longer the tensioning warp threads (3) according to a ground weave structure that repeats itself in weft direction by, for instance, a weaving frame drive, but to position also these tensioning warp threads (3) by means of the jacquard arrangement. By doing so, the weft threads (6) are made visible at certain places in the fabric at least at one side of the fabric, which allows realizing additional effects in the created figure. In FIGS. 15*a* and 15*b*, we see that the fourth, fifth and seventh weft thread (6) are visible (from the left side onward) along the topsides of the fabrics (W1), (W2), whereas the third, sixth and eighth weft threads (6) are visible along the bottom sides of the fabrics (W1), (W2). By providing a yarn selector for insertion of the weft threads (6) and by providing visible weft threads (6) with different properties (structure, color) yet additional effects can be realized in the shaped figure.

In certain cases, the warp threads (1–5, 11, 12) for weaving of the fabrics (W1), (W2) according to the invention can be added from one or more warp beams with equal consumption over the width of the weaving machine. Fabrics that have a tensioning warp thread (3) inserted require at least two warp beams on the weaving machine.

Figure 16A:
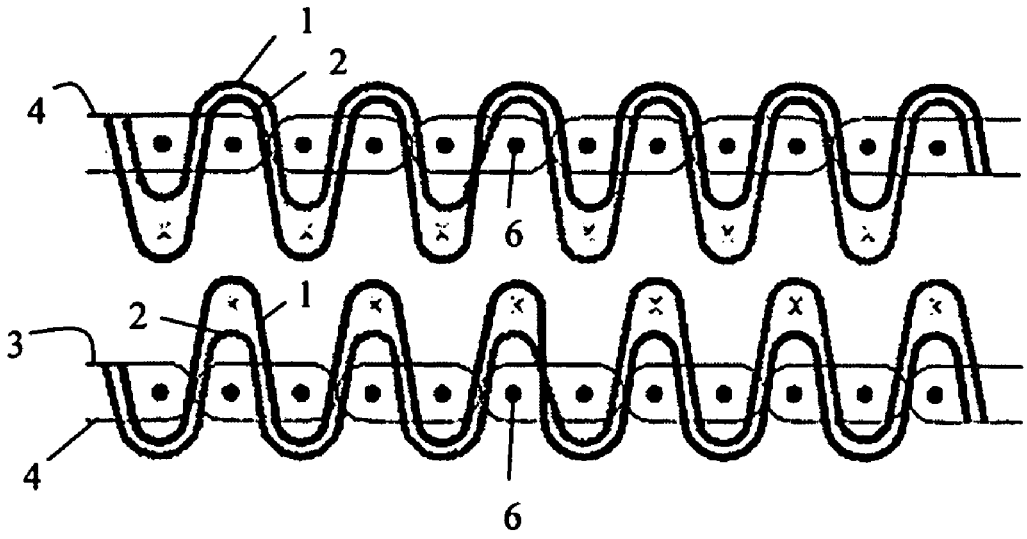
Figure 16B:
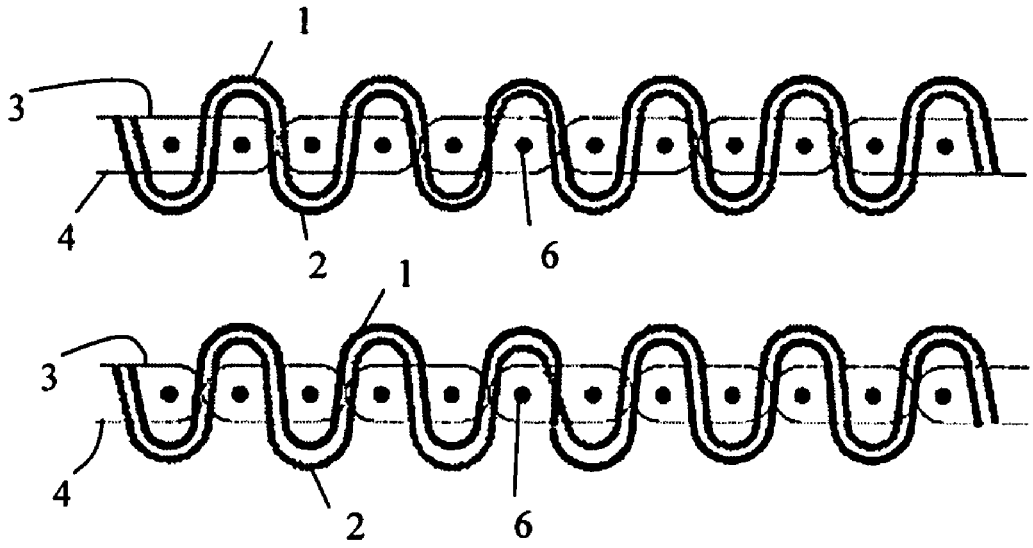

The fabrics (W1), (W2) can also be produced without tensioning warp threads (3), as shown in FIGS. 16*a* and 16*b*, in which the weft threads (6) will position themselves next to each other and will be visible between the figure warp threads (1), (2). Here also, introduction of a weft selector will allow realizing additional effects by bringing in visible weft threads (6) of a different color or structure.

Because of uneven consumption, when inserting additional figure warp threads (11) (12) or when driving the tensioning warp threads (3) over the harness of the jacquard arrangement, we must feed warp threads from bobbins that, for instance, can be installed in a weaving creel.

Obviously, besides the described examples of methods, fabrics and weaving machines according to this invention, many other methods, fabrics and weaving machines can be produced on basis of the general inventive idea of this invention.

The invention claimed is:

1. Method for weaving of a fabric (W1), (W2), characterized in that in successive work cycles of a weaving machine a shed is formed between the warp threads (1–5) of a number of warp thread systems and one weft thread (6) is inserted in this shed at a weft insertion level, and characterized in that, in each shed, the warp threads (1–5) are positioned in relation to the weft insertion level in a manner that, together with the inserted weft threads (6), they form a fabric (W1), (W2) that displays on both sides figure shaping warp threads (1), (2), characterized in that at least one warp thread system comprises a first (1) and second figure warp thread (2) that, in a number of operating cycles, are positioned together alternately above and under the weft insertion level, so that, at both fabric sides, these figure warp threads (1), (2) are bound over the same weft threads (6), while running above one another, the upper figure warp thread (1), (2) being figure shaping at the topside of the fabric (W1), (W2) and the lower figure warp thread (1), (2) being figure shaping at the bottom side of the fabric (W1), (W2), and characterized in that, during the weaving process, the mutual position taken up in the fabric (W1), (W2) by the first (1) and the second figure warp thread (2) is determined selectively according to a previously defined figure pattern.

2. Method for weaving of a fabric according to claim 1, characterized in that said first (1) and second figure warp threads (2) are positioned in a first shed (I) at a first level (POS. 1) at one side of the weft insertion level and are positioned in a second shed (II) at a different second level (POS. 2) and a third level (POS. 3) at the other side of the weft insertion level, and characterized in that the positions (POS. 2; POS. 3) of the first figure warp thread (1) and the second figure warp thread (2) in the second shed determine said mutual position of the two figure warp threads (1), (2) running above one another, and characterized in that said positions are determined during the weaving process according to a previously defined figure pattern.

3. Method for weaving of a fabric according to claim 2, characterized in that in the second shed (II), the positions (POS. 2; POS. 3) of the first figure warp thread (1) and the second figure warp thread (2) determine said mutual position of the figure warp threads (1), (2), running above one another, when they are bound over the weft thread (6) inserted during the first shed (I).

4. Method for weaving of a fabric according to claim 3, characterized in that the figure warp thread (1), (2) positioned in the second shed (II) in the position (POS. 2) located nearest to the weft insertion level takes up the figure shaping position in the fabric (W1), (W2) when bound over the weft thread (6) inserted during the first shed (I).

5. Method for weaving of a fabric according to claim 2, characterized in that alternately a first (I) and a second shed (II) is applied.

6. Method for weaving of a fabric according to claim 1, characterized in that the first figure warp thread (1) and the second figure warp thread (2) are not separated from each other by a weaving machine element, such as a reed dent or spacer.

7. Method for weaving of a fabric according to claim 1, characterized in that the first figure warp thread (1) and the second figure warp thread (2) are provided adjacent to each other on the weaving machine.

8. Method for weaving of a fabric according to claim 1, characterized in that, per warp thread system, at least one tensioning warp thread (3) is provided and that the successive weft threads (6) are provided alternately above and below the tensioning warp threads (3), so that a fabric is shaped that has two layers of weft threads (6).

9. Method for weaving of a fabric according to claim 1, characterized in that the first figure warp thread (1) and/or the second figure warp thread (2) are positioned above or below the weft insertion level for several operating cycles.

10. Method for weaving of a fabric according to claim 1, characterized in that at least one warp thread system comprises a group of at least three figure warp threads (1), (2), (11), (12) of a different color or aspect, also characterized in that both figure warp threads that, together, are bound in a figure shaping manner in the fabric for a number of operating cycles, are chosen from this group according to the desired figure pattern at both fabric sides, and furthermore characterized in that during these operating cycles every other figure warp thread of the group is bound in the fabric in a non-figure-shaping manner.

11. Method for weaving of a fabric according to claim 9, characterized in that each non-figure-shaping figure warp thread is bound in the fabric while in a stretched manner running together with a tensioning warp thread (3).

12. Method for weaving of a fabric according to claim 9, characterized in that at least one warp thread system comprises a group of figure warp threads with a first pair of figure warp threads of a first color, structure or aspect and a second pair of figure warp threads of a second color, structure or aspect, and characterized in that both figure warp threads (1), (2) that are bound together in a figure shaping manner in the fabric always belong to the same pair.

13. Method for weaving of a fabric according to claim 1, characterized in that all figure warp threads of a number of warp thread systems are bound in a non-figure-shaping manner in the fabric for a number of operating cycles, so that, at least at one fabric side, at a certain location, the weft threads are bound visibly according to a previously defined figure pattern.

14. Method for weaving of a fabric according to claim 1, characterized in that, per warp thread system, at least one tensioning warp thread is provided, and characterized in that each tensioning warp thread is positioned in such way in relation to the weft insertion level that, at least at one fabric side, at a certain location, a number of weft threads is bound visibly according to a previously defined figure pattern.

15. Method for weaving of a fabric according to claim 14, characterized in that at least one tensioning warp thread is positioned by means of a jacquard arrangement.

16. Method for weaving of a fabric according to claim 13, characterized in that first and second weft threads of a different color or aspect are inserted, and characterized in that the weft threads visible at a certain location comprise both first and second weft threads.

17. Method for simultaneous weaving of at least two fabrics (W1), (W2) on a weaving machine comprising at least a same number of weft insertion devices as the number of fabrics to be woven, which are provided to insert weft threads (6) at a respective weft insertion level, in which for each fabric, in successive operating cycles of the weaving machine, in relation to a different weft insertion level, a shed is formed between a number of warp threads (1–5) of a number of warp thread systems and one weft thread (6) is inserted in each shed, characterized in that, in each shed, the warp threads (1–5) are positioned in relation to the related weft insertion level in a way that, together with the inserted weft threads (6), they form a fabric (W1), (W2) that displays figure shaping warp threads (1), (2) at both sides, also characterized in that, per fabric, at least one warp thread system comprises a first figure warp thread (1) and a second figure warp thread (2), which, in a number of operating cycles, are together positioned alternately above and below the weft insertion level, so that these figure warp threads (1), (2), are bound over the same weft threads (6) at both fabric sides while running above one another, the upper warp thread (1), (2) being figure shaping at the topside of the fabric (W1), (W2) and the lower warp thread (1), (2) being figure shaping at the bottom side of the fabric (W1), (W2), and further characterized in that the mutual position taken up by the first (1) and the second warp thread (2) in each fabric (W1), (W2) is selectively determined during the weaving process according to a previously defined figure pattern.

18. Method for simultaneous weaving of at least two fabrics (W1), (W2) on a weaving machine, according to claim 17, characterized in that upon positioning of first (1) and second figure warp threads (2) in the mentioned first (I) and second sheds (II), the lowest level in relation to the upper weft insertion level (IB) is situated above the lower weft insertion level (IA) in relation to two weft insertion levels (IB, IA) that are positioned above one another.

19. Method for simultaneous weaving of at least two fabrics (W1), (W2) on a weaving machine, according to claim 17, characterized in that the first (1) and second figure warp threads (2) are located between the weft insertion devices (10), (11) intervening on these weft insertion levels (IB), (IA), both at the mentioned first level (POS. 1B) in relation to the upper weft insertion level (IB) and at the mentioned first level (POS. 1A) in relation to the lower weft insertion level (IA).

20. Method for simultaneous weaving of at least two fabrics (W1), (W2) on a weaving machine, according to claim 17, characterized in that the first (1) and second figure warp threads (2) are located between the weft insertion devices (10), (11) intervening on these weft insertion levels (IB), (IA), both at the mentioned second (POS. 2B) and third levels (POS. 3B) in relation to the upper weft insertion level (IB) and at the mentioned second (POS. 2A) and third levels (POS. 3A) in relation to the lower weft insertion level (IA).

21. Method for simultaneous weaving of at least two fabrics (W1), (W2) on a weaving machine, according to claim 17, characterized in that in at least one warp thread system at least one figure—warp thread (11) is positioned in a way that it is bound alternately over a weft thread of an upper fabric (W1) and over a weft thread of a lower fabric (W2), and is cut between these fabrics (W1), (W2) so that respective areas with cut pile are formed on the facing fabric sides.

22. Weaving machine comprising shed formation devices, provided to form a shed in successive operating cycles between a number of warp threads, as well as a weft insertion device (7, (8), provided to insert one weft thread (6) in this shed on a weft insertion level (IB), (IA) in each operating cycle, characterized in that the shed formation devices are provided to position two figure warp threads (1), (2) of a same warp thread system in a first operating cycle at a first level (POS. 1) at one side of the weft insertion level (IB), (IA) and to bring these figure warp threads in a second operating cycle to a different second level (POS. 2) and third level (POS. 3) at the other side of the weft insertion level (IB), (IA).

23. Weaving machine comprising at least two weft insertion devices (7), (8), provided to insert in each operating cycle one weft thread (6) at a respective weft insertion level (IB), (IA), as well as shed formation devices provided to form a shed in relation to each weft insertion level in successive operating cycles, characterized in that the shed formation devices are provided to bring, in relation to each weft insertion level, two figure warp threads (1), (2) of a same warp thread system in a first operating cycle to a first level (POS. 1) at one side of the weft insertion level (IB), (IA) and to bring both these figure warp threads (1), (2) in a second operating cycle to a different second (POS. 2) and third level (POS. 3) at the other side of the weft insertion level (IB), (IA).

24. Weaving machine according to claim 23, characterized in that the mentioned second level (POS. 2) and third level (POS. 3) are located between two weft insertion levels (IB), (IA) located above one another.

25. Weaving machine according to claim 23, characterized in that it is provided to perform alternately a first and a second operating cycle.

26. Weaving machine according to claim 22, characterized in that the distance between the mentioned second level (POS. 2) and third level (POS. 3) is smaller than the distance between the first level (POS. 1) and the second level (POS. 2).

27. Weaving machine according to claim 26, characterized in that the distance between said second level (POS. 2) and third level (POS. 3) is about half the distance between the first level (POS. 1) and second level (POS. 2).

28. Weaving machine according to claim 22, characterized in that it comprises a jacquard arrangement to bring the warp threads to the first level (POS. 1), the second level (POS. 2) and the third level (POS. 3).

29. Weaving machine according to claim 28, characterized in that said jacquard arrangement is a non-open-shed jacquard arrangement, preferably a non-open-shed jacquard arrangement with at least three positions.

30. Weaving machine according to claim 28, characterized in that said jacquard arrangement is an open-shed jacquard arrangement, preferably an open-shed jacquard arrangement with at least three positions.

31. Weaving machine according to claim 28, characterized in that said jacquard arrangement is a jacquard arrangement with four positions.

32. Fabric displaying at both sides figure shaping warp threads (1) (2), and comprising a series of weft threads (6) inter woven with warp threads (1–5), characterized in that the fabric (W1), (W2) comprises a first figure warp thread (1) and a second figure warp thread (2) that together run alternately above and below one or more weft threads (6), so that, these figure warp threads (1), (2) are bound at both fabric sides over the same weft threads (6) while running above one another, the upper figure warp thread (1), (2)

being figure shaping at the topside of the fabric (W1), (W2) and the lower figure warp thread (1), (2) being figure shaping at the bottom side of the fabric (W1), (W2), and characterized in that the mutual position taken up in the fabric (W1), (W2) by the first figure warp thread (1) and the second figure warp thread (2) changes according to their position in the fabric, so that a drawing, figure or pattern is obtained at both fabric sides.

33. Fabric according to claim 32, characterized in that it comprises tensioning warp threads (3), and characterized in that the successive weft threads (6) are provided alternately above and below the tensioning warp threads (3), so that the fabric comprises two layers of weft threads (6).

34. Fabric according to claims 32, characterized in that it comprises figure warp threads that are bound in the fabric in a non-figure-shaping manner.

35. Fabric according to claim 32, characterized in that the fabric comprises at least one warp run with groups of figure warp threads, each group comprising a first pair of figure warp threads of a first color, structure or aspect and a second pair of figure warp threads of a second color, structure or aspect, and characterized in that both figure warp threads (1), (2) that together are bound in a figure shaping way in the fabric always belong to the same pair, so that a virtually identical figure, drawing or pattern is obtained at both fabric sides.

36. Fabric according to claim 32, characterized in that the fabric comprises weft threads that, at least at one fabric side, are bound visibly at a certain location.

37. Fabric according to claim 32, characterized in that the fabric comprises first (6) and second weft threads (6) of a different color or aspect, and characterized in that the weft threads that are visible at a certain location comprise both first and second weft threads.

* * * * *